US007992870B2

(12) United States Patent
Yamaguchi

(10) Patent No.: US 7,992,870 B2
(45) Date of Patent: Aug. 9, 2011

(54) SHEET CONVEYING APPARATUS AND IMAGE FORMING APPARATUS

(75) Inventor: Yoshinori Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 12/508,024

(22) Filed: Jul. 23, 2009

(65) Prior Publication Data

US 2010/0025917 A1 Feb. 4, 2010

(30) Foreign Application Priority Data

Jul. 29, 2008 (JP) ..... 2008-194801
Jun. 4, 2009 (JP) ..... 2009-135314

(51) Int. Cl.
*B65H 5/02* (2006.01)

(52) U.S. Cl. ..... 271/273; 271/272

(58) Field of Classification Search ..... 271/272, 271/273

See application file for complete search history.

(56) References Cited

U.S. PATENT DOCUMENTS 5,182,861 A * 2/1993 Suzuki et al. ..... 33/18.1
5,865,432 A * 2/1999 Lee ..... 271/274
6,752,495 B2 * 6/2004 Izuma ..... 347/108
7,281,791 B2 * 10/2007 Anami et al. ..... 347/104
7,422,320 B2 * 9/2008 Sugiura ..... 347/104
2006/0181015 A1 * 8/2006 Takahashi ..... 271/273
2007/0102873 A1 * 5/2007 Acton et al. ..... 271/273
2008/0061499 A1 * 3/2008 DeGruchy et al. ..... 271/273

FOREIGN PATENT DOCUMENTS

JP 11-091985 A 4/1999
JP 2006-315816 A 11/2006

* cited by examiner

*Primary Examiner* — Kaitlin Joerger

(74) *Attorney, Agent, or Firm* — Canon USA Inc. IP Division

(57) ABSTRACT

A sheet conveying apparatus comprising a pair of rollers configured to pinch a sheet to be conveyed, a driving source, a roller mechanism configured to change a clearance between the pair of rollers with a force generated by the driving source, and a manual mechanism including an operation member which a user manually moves and a transmission mechanism configured to transmit a manual force from the operation member to the roller mechanism to change the clearance between the pair of rollers, wherein the transmission mechanism is configured to cut off transmission of the force generated by the driving source to the operation member when the manual mechanism is in a default state.

10 Claims, 16 Drawing Sheets

SHEET CONVEYING APPARATUS AND IMAGE FORMING APPARATUS

BACKGROUND OF THE INVENTION

1. Field of the Invention

The present invention relates to a sheet conveying apparatus that pinches a sheet to be conveyed, and an image forming apparatus that forms an image on the conveyed sheet.

2. Description of the Related Art

An image forming apparatus such as a printer, a copier, and a facsimile machine pinches a sheet such as roll paper, a role film, and a cut-sheet with a conveyance roller and a pinch roller that is driven by the conveyance roller. The sheet is conveyed by the rotating conveyance roller, whereby an image is formed on the sheet in the image forming section.

A mechanism is conventionally known which a user can manually release a sheet pinched by a conveyance roller and a pinch roller. The mechanism allows a user to operate an operation lever to separate the pinch roller from the conveyance roller to release the pinching state. In a case where a roll sheet is loaded after the release, a leading edge of the sheet is sent into a sheet discharging section via a conveyance section and an image forming section, and then the operation lever is returned to the original position to press the pinch roller towards the conveyance roller side to pinch the sheet. In a case where roll paper left in the conveyance section due to paper-jamming is to be removed, the operation lever is manually operated to release the pinch roller in the pinching state and then the sheet is returned to the upper stream side before rewinding.

In order to improve the above complex manual operation by the user, an apparatus is provided which executes a release of a pinched sheet by a drive motor. More specifically, a mechanism is provided which moves a pinch roller by a force of an electric driving source according to an instruction from the user or a detection signal of paper-jamming. Return of the sheet to the pinching state after the release processing is also performed by a drive motor (Refer to Japanese Patent Application Laid-Open No. 11-91986, and Japanese Patent Application Laid-Open No. 2006-315816.)

In an apparatus which moves a pinch roller by a drive motor, the pinch roller may suspend its operation at an unexpected position relative to the conveyance roller while the sheet is left in the image forming section when the apparatus encounters an unexpected technical issue such as a power drop caused by power failure during use, or suspension of an operation caused by a system error. In a recovery operation, complex procedures need to be taken. Namely, the user powers on the apparatus again and gives the apparatus an instruction to release pinching of the sheet. Then, the user resets the remaining sheets at the correct positions before giving the apparatus an instruction to execute the pinching operation again.

Removing and resetting of the remaining sheets can be carried out faster if the user manually opens and closes the pinch roller of the apparatus in a powered off state. An apparatus discussed in the above patent documents is, however, equipped with no mechanism for manually opening and closing the pinch roller, therefore, the possibility of a fast recovery operation is reduced in the above complex procedures.

Supposing the apparatus is powered on while the sheet remains in the image forming section, a head loaded on a carriage can contact the sheet and be damaged due to movement of the carriage in the image forming section in the scanning direction. If the apparatus is powered on to execute a recovery in a state where the pinch roller does not completely contact the conveyance roller, the pinch roller may hit the carriage and cause damage to the carriage.

SUMMARY OF THE INVENTION

The present invention is directed to a sheet conveying apparatus and an image forming apparatus which further improve reliability and operability, and can reduce the time for recovery from an unexpected technical issue.

According to an aspect of the present invention, a sheet conveying apparatus comprises a pair of rollers configured to pinch a sheet to be conveyed, a driving source, a roller mechanism configured to change a clearance between the pair of rollers with a force generated by the driving source, and a manual mechanism including an operation member which a user manually moves and a transmission mechanism configured to transmit a manual force from the operation member to the roller mechanism to change the clearance between the pair of rollers, wherein the transmission mechanism is configured to cut off transmission of the force generated by the driving source to the operation member when the manual mechanism is in a default state.

Further features and aspects of the present invention will become apparent from the driving detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Although an ink jet printer is described as an example of an image forming apparatus which forms an image on a sheet, according to an exemplary embodiment of the present invention, an application of the present invention is not limited to the exemplary embodiment. The present invention is applicable, for example, to printers in various systems such as an electrophotographic system, a thermal system, a dot impact system, and to an image forming apparatus in office use and home use such as a copier, a facsimile, and a multifunction peripheral. The present invention is also applicable to a production apparatus and an industrial device which are equipped with a sheet conveying apparatus conveying a sheet shape article (such article is also referred to as a sheet in the present specification).

Figure 1:
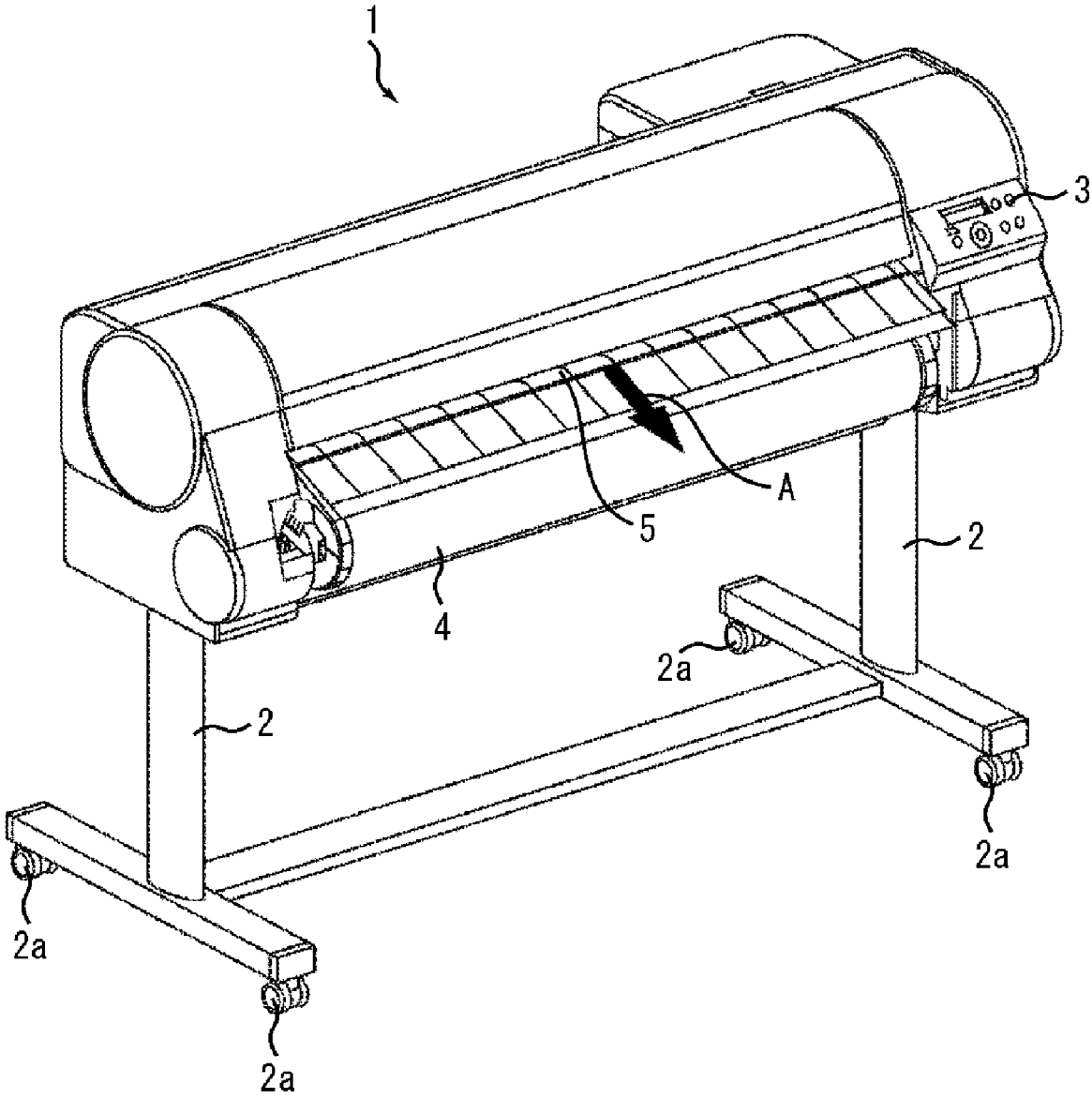
FIG. 1 is a perspective diagram illustrating an appearance of an ink jet printer according to an exemplary embodiment of the present invention.

FIG. 1 is a perspective view illustrating an inkjet printer according to an exemplary embodiment of the present invention. FIG. 1 illustrates a printer body 1 that is structured as a color plotter using a sheet such as paper and film. The printer body is fixed on an upper stand 2 with a caster 2*a*. The printer body 1 is equipped with an operation section 3. Various switches provided on the operation section 3 indicate the sheet size, an on-line/off-line, and commands. A roll sheet 4, which is a recording medium, is set on a roll sheet storage section, and conveyed to the inside of a printer based on an instruction at the operation section 3. A color image is printed by an inkjet recording system at an image forming section and the printed sheet is discharged from a discharge tray 5 in the direction of an arrow A.

Figure 2:
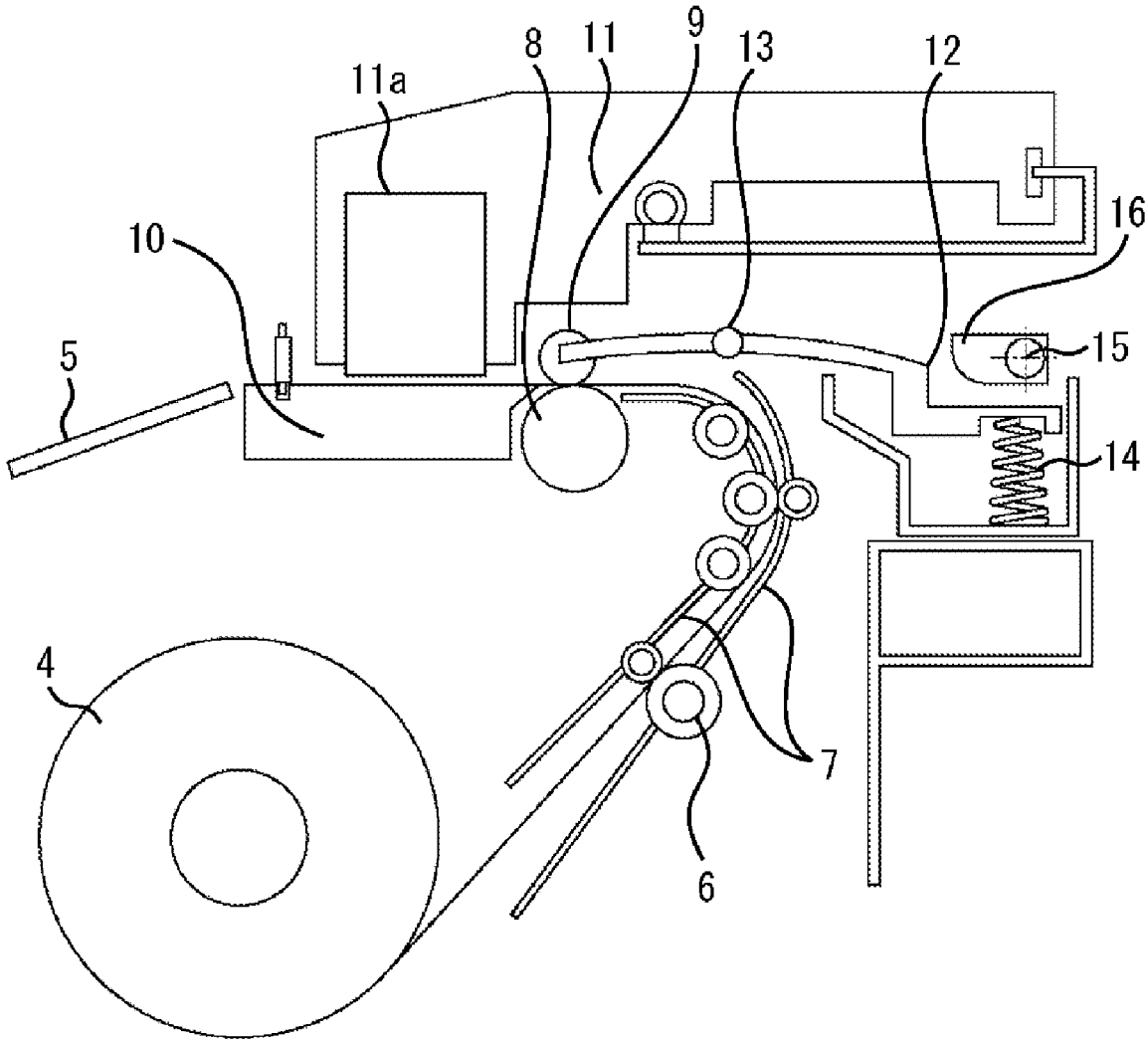
FIG. 2 illustrates an internal structure of an apparatus in FIG. 1.

FIG. 2 is a vertical sectional view illustrating an internal structure of an apparatus in FIG. 1. A series of operations, that is, supplying, printing, and discharging of a roll sheet, will be described with reference to FIG. 2. A roll sheet 4 is provided with a spool shaft in a tube located in its center, and attached to a specified position in the roll sheet storage section of the printer body 1 while fixed and retained by a tube lock section of the roll sheet holder.

When a user sends the leading edge of a roll sheet up to a roller 6, a sensor mounted in its vicinity detects the sheet, which causes the roller 6 to start rotating to convey the sheet along a conveyance guide 7 up to a conveyance roller 8. The sheet is pinched by a pair of rollers including the conveyance roller 8 and a pinch roller 9 driven by the conveyance roller, and conveyed up to a platen 10 in the printing area. A recording head 11*a* in an inkjet system is positioned facing the platen 10, and the recording head 11*a* is loaded on a carriage 11. A sensor mounted on the carriage 11 detects the sheet width and the position of the leading edge. The conveyance operation is stopped and remains in a print stand-by state when the leading edge of the sheet comes to the predetermined stand-by position.

FIG. 2 illustrates a state where the pinch roller 9 is urged by the conveyance roller 8 and the roller pair pinches the sheet between them. The pinch roller 9 functions as a follower roller which is driven by the conveyance roller 8 or the pinched sheet, and rotatably supported at one end of an arm 12. The arm 12 pivots around a supporting shaft 13, and rotates around the supporting shaft 13. The arm 12 rotates around the supporting shaft 13 while one end of the arm 12 opposite to a portion supporting the pinch roller 9 is urged with a force of a spring 14 from downwards. Thus, the pinch roller 9 is urged to the conveyance roller 8. A rotatable cam 16 is positioned above the arm 12 at a position where the spring 14 applies the force.

The cam 16 rotates around a cam shaft 15, and contacts a cam follower surface at the end of the arm 12 at a certain angle to press the cam follower surface downward. At a time of normal stand-by and printing, the cam 16 stops at a start angle as FIG. 2 illustrates. Since the cam 16 does not press the cam follower surface of the arm 12 down in this state, the pinch roller 9 is in a position (the first position) where the pinch roller is urged by the conveyance roller 8 under the force of the spring 14 (plus the own weight of the pinch roller).

In case of releasing the force of the pinch roller 9 applied to the conveyance roller 8, the cam 16 rotates to press the cam follower surface of the arm 12 down against the force applied by the spring 14. Thus, the pinch roller 9 moves upward to a position (the second position) separate from the conveyance roller 8. Rotational driving force of the cam shaft 15 that supports the cam 16 is given either by a driving source such as a motor or a user operating the release lever 22 as described below.

Thus, the mechanism for opening and closing a roller moves the pinch roller 9 in the vertical direction relative to the conveyance roller 8 and changes the clearance (distance) between both rollers by way of the cam shaft 15, the cam 16, and the arm 12.

Figure 3:
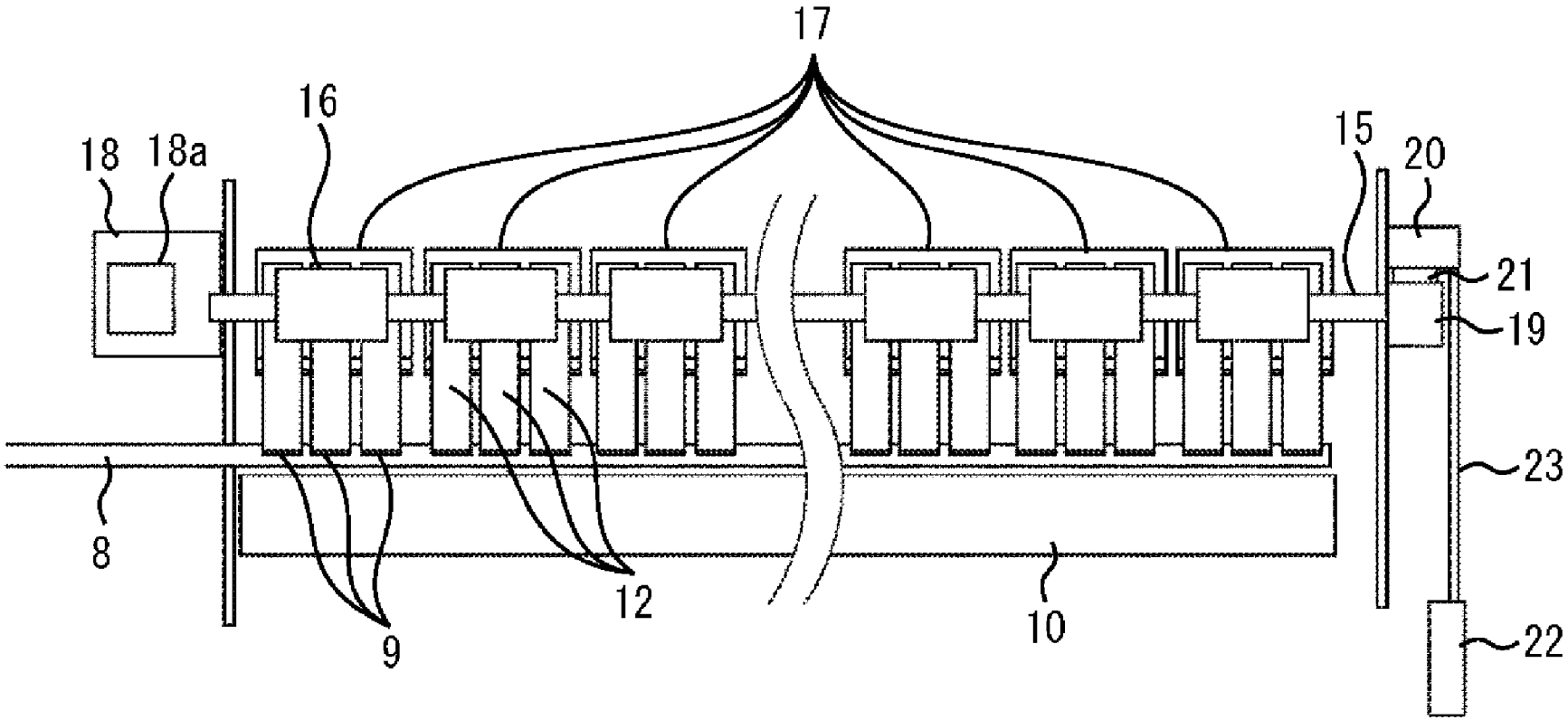
FIG. 3 is a top view illustrating an internal of the apparatus in FIG. 2 observed from the above.

FIG. 3 is a top view illustrating an internal structure of the apparatus in FIG. 2 observed from above. FIG. 3 illustrates a plurality of pinch roller units 17 aligned and mounted in a sheet width direction. The pinch roller units 17 respectively have the pinch roller arm 9, the arm 12 as previously described, and the spring 14, which is hidden in the figure. Each of the plurality of pinch rollers 9 aligned in the sheet width direction abuts the conveyance roller 8. In a case where a sheet is present between the rollers, the pinch rollers 9 abut the conveyance roller 8 across a sheet. Three of the arms 12 constitute one unit and the cam 16 is provided for each unit. A plurality of cams 16 is fastened to one common cam shaft 15.

At one end of the cam shaft 15, a driving mechanism 18 is attached to give the cam shaft 15 a rotational driving force. The driving mechanism 18 incorporates an electric motor 18*a* as a driving source, which generates physical rotation force, and power transmission mechanisms.

Meanwhile, the other end of the cam shaft 15 is supported by a side panel, and a cam gear 19 is attached to its top, in which the arm-shaped first rotation member 21 is provided. The rotation member 21 has at its end a rotating gear which meshes with a gear of the cam gear 19. A gear shaft at the end of the rotation member 21 is supported by a side plate. An arm is rotated around the shaft in conjunction with a rotation of the cam gear 19. An end of the arm-shaped second rotation member 20 is supported by a side plate near the first rotation member 21. A release lever 22 (operation member) is connected to the second rotation member 20 via a link plate 23.

When a user manually operates the release lever 22, the second rotation member is rotated by its force. A manually operating mechanism (a manual mechanism) is formed of these members. Namely, the manual mechanism includes the operation member which a user manually moves and a transmission mechanism configured to transmit a manual force given by the operation member to the roller mechanism to change the clearance between the pair of rollers.

The driving mechanism 18 is used when the pinch roller 9 is electrically separated or contacted. Rotational force of the built-in electric motor 18*a* is transmitted to the cam shaft 15. Rotation of the cam shaft 15 causes each of the pinch rollers 9 to move to the conveyance roller 8. By a sensor (not illustrated) detecting a rotation position of the cam shaft 15, a position where the pinch rollers 9 is released, is detected. As needed, a rotation phase of the cam 16 is changed so that a released state of the pinch rollers 9 can be controlled. Since a plurality of the cams 16 is independently provided, a force applied by the corresponding pinch rollers 9 or timing of separating the pinch rollers 9 can be adjusted when the respective heights of the cams (pressing amount) or a phase of a rotating surface are adjusted.

The driving mechanism 18 includes a clutch mechanism that transmits a force in one way and an electric motor as a driving source. The driving mechanism cuts off transmission of the rotation of the cam shaft 15 to the built-in electric motor 18*a* when the rotation is given from the release lever 22 side.

Figure 4:
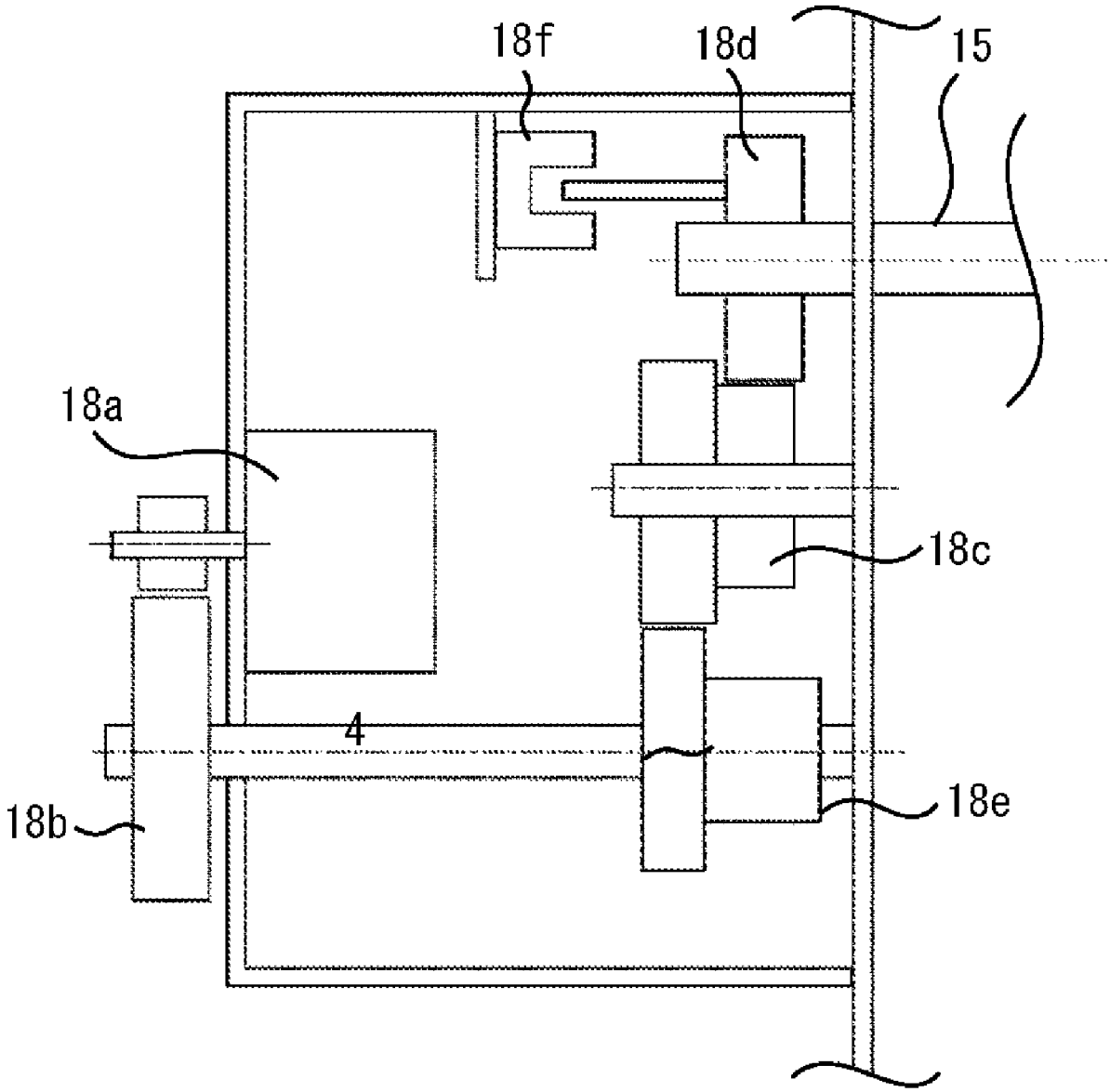
FIG. 4 is a diagram illustrating an internal structure of a driving mechanism according to the present exemplary embodiment.

FIG. 4 illustrates a structure of the driving mechanism 18 having the clutch mechanism. Rotation generated by the electric motor 18*a* is transmitted to the cam shaft 15 via the gears 18*b*, 18*c*, and 18*d*. A clutch 18*e* is provided between the gears, more specifically, between the gears 18*b* and 18*c*. The clutch 18*e* is configured to switch between transmission and cutting-off of the rotation. A sensor 18*f* detects the gear 18*d*, in other words, a rotation phase of the driving shaft 15. The sensor 18*f* detects movement of the members which are provided at the gear 18*d* and transmitted along with the rotation.

The clutch 18*e* with the above structure is in a connection state when the electric motor 18*a* drives the cam shaft 15. When the electric motor 18*a* does not drive the cam shaft 15, the clutch 18*e* is released to uncouple the connection, which cuts off the transmission of the rotation of the cam shaft 15 to the gear 18*b* and the electric motor 18*a*. When the cam shaft 15 is driven by the operation of the release lever 22, the rotation of the cam shaft 15 is not transferred to the gear 18*b* and the electric motor 18*a*. The clutch mechanism transfers the force generated by the driving source to the roller opening and closing mechanism, and cuts off the transmission of the manual force generated in the manual mechanism by a user, to the driving source. Thus, the operation force when a user operates the release lever 22, is reduced and practicality is increased.

The clutch mechanism is not limited to the one which is incorporated into the driving mechanism 18, but can also be provided between the driving mechanism 18 and the cam shaft 15. The clutch mechanism only needs to be provided in the transmission path between the driving source, and the roller opening and closing mechanism.

The driving mechanism 18 is not limited to the one which uses an electric motor as a driving source, but an actuator which uses electricity, fluid such as, liquid, or air, and various systems which convert input energy into physical force, can be utilized.

Figure 5:
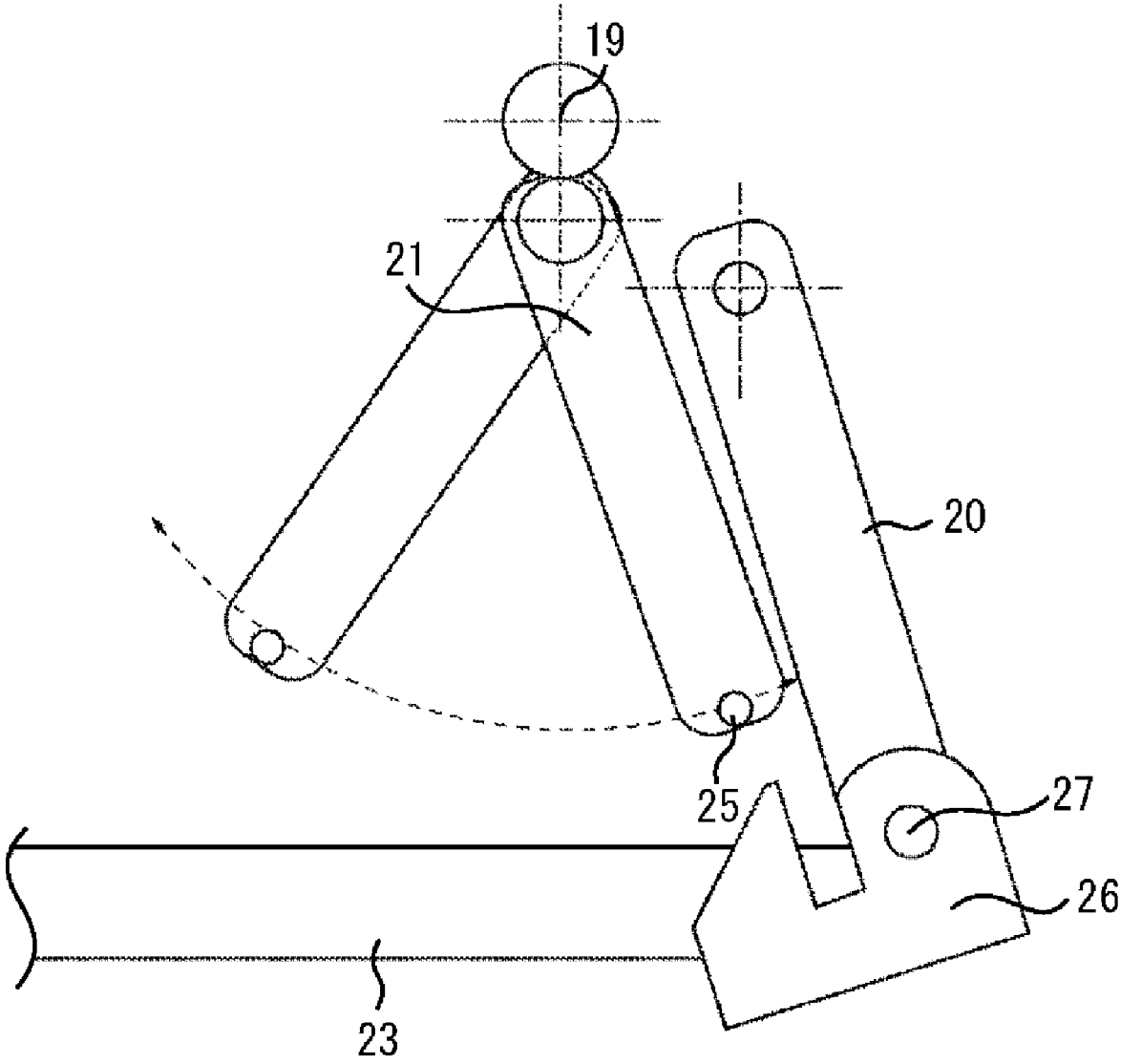
FIG. 5 is a side view illustrating the structure in FIG. 3 observed from the right side.

Next, the operations are described which give the rotational driving force from the driving mechanism 18 side and from the release lever 22 side in the manual mechanism to the cam shaft 15. FIG. 5 is a side view of a structure in FIG. 3 as observed from the right side surface and illustrates motion of an apparatus when the release lever 22 is operated in the manual mechanism.

The first rotation member 21 rotates around a spindle at its upper end like a pendulum. The second rotation member 20 also rotates around a spindle at its upper end like a pendulum. The spindles of the first rotation member 21 and the second rotation member 20 are away from each other as illustrated in FIG. 5. An engaging shaft 25 is provided at the lower end of the first rotation member 21. An engaging portion 26 pivots around a rotation shaft 27 at the lower end of the second rotation member 20. The engaging portion 26 has a nail-shaped part, and is positioned to become engaged with the engaging shaft 25 at certain timing. The engaging shaft 25 and the engaging portion 26 constitute an engaging mechanism. By the engaging mechanism, the first rotation member 21 and the second rotation member 20 are linked and synchronized with each other as needed. When the release lever 22 is not in operation, the release lever 22, link plate 23 and the second rotation member 20 are in a start position as illustrated in FIG. 5, which is a default state of the manual mechanism.

The second rotation member 20 and the engaging portion 26 are normally fixed at an angle illustrated by FIG. 5 under a force applied by an elastic element such as a spring and rubber (not illustrated). The engaging portion 26 rotates counterclockwise against the spring force around the rotation shaft 27. Thus, the engaging portion 26 can be displaced relative to the second rotation member 20. A link plate 23 supports the second rotation member 20, and is further connected to the release lever 22 at its end.

Now, rotational movement is described in a case where the driving mechanism rotates a cam shaft. A cam shaft 19 rotates along with the cam shaft 15 rotated by the driving mechanism 18 and the first rotation member 21 rotates in conjunction with the cam shaft 19. However, the second rotation member 20, when in a default state as illustrated in FIG. 5, does not rotate because it is not linked to the first rotation member 21. Therefore, the release lever 22 connected to the second rotation member 20 does not move. The release lever 22 does not move either when the pinch roller 9 shifts from the urging position (the first position) to the separated position (the second position), or when the pinch roller 9 shifts from the separated position (the second position) to the urging position (the first position). In other words, the transmission mechanism of the manual mechanism cuts off transmission of the force generated by the driving source of the driving mechanism 18 to the release lever 22 (operating member) when the manual mechanism is in the default state since the first rotation member 21 and the second rotation member 20 are not linked to each other.

Figure 6:
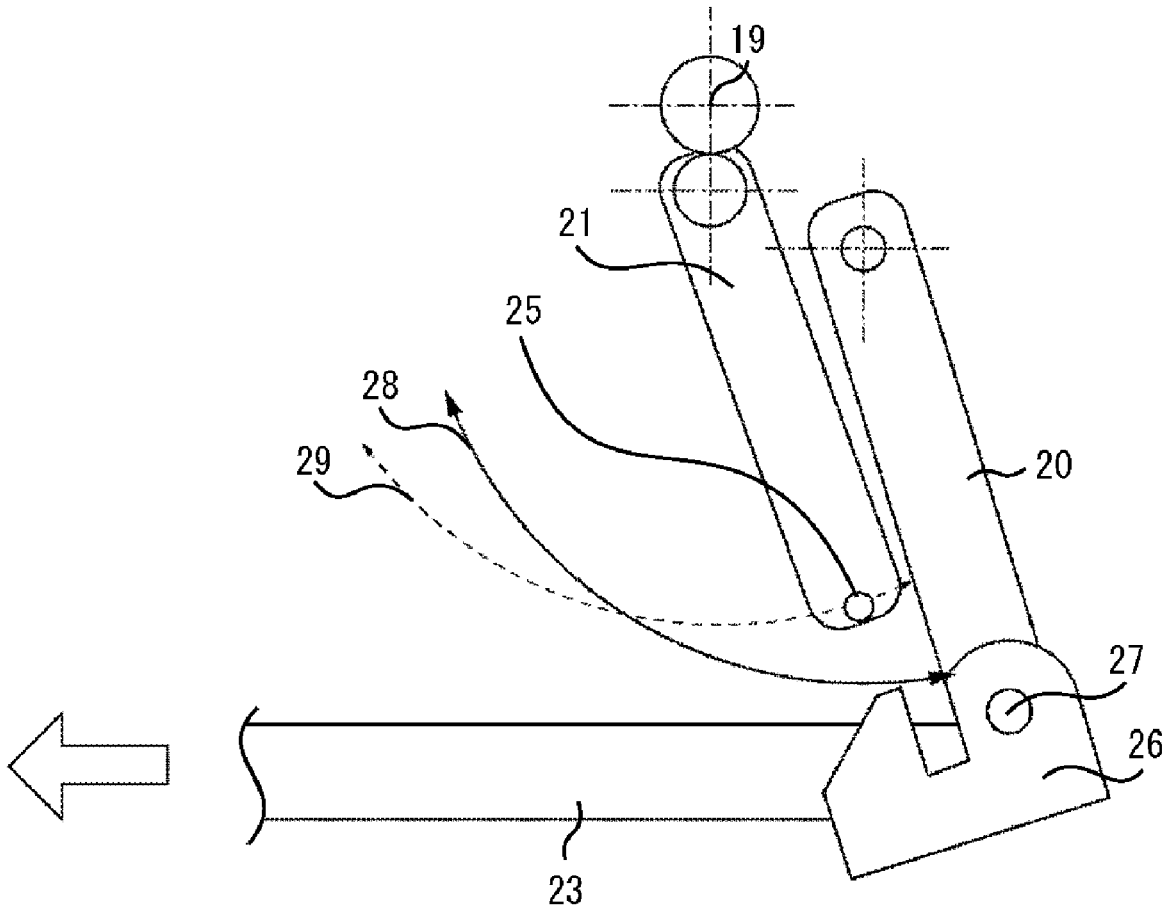
FIG. 6 is a diagram illustrating an operation of a release lever mechanism at the time of opening and closing a pinch roller.
Figure 7:
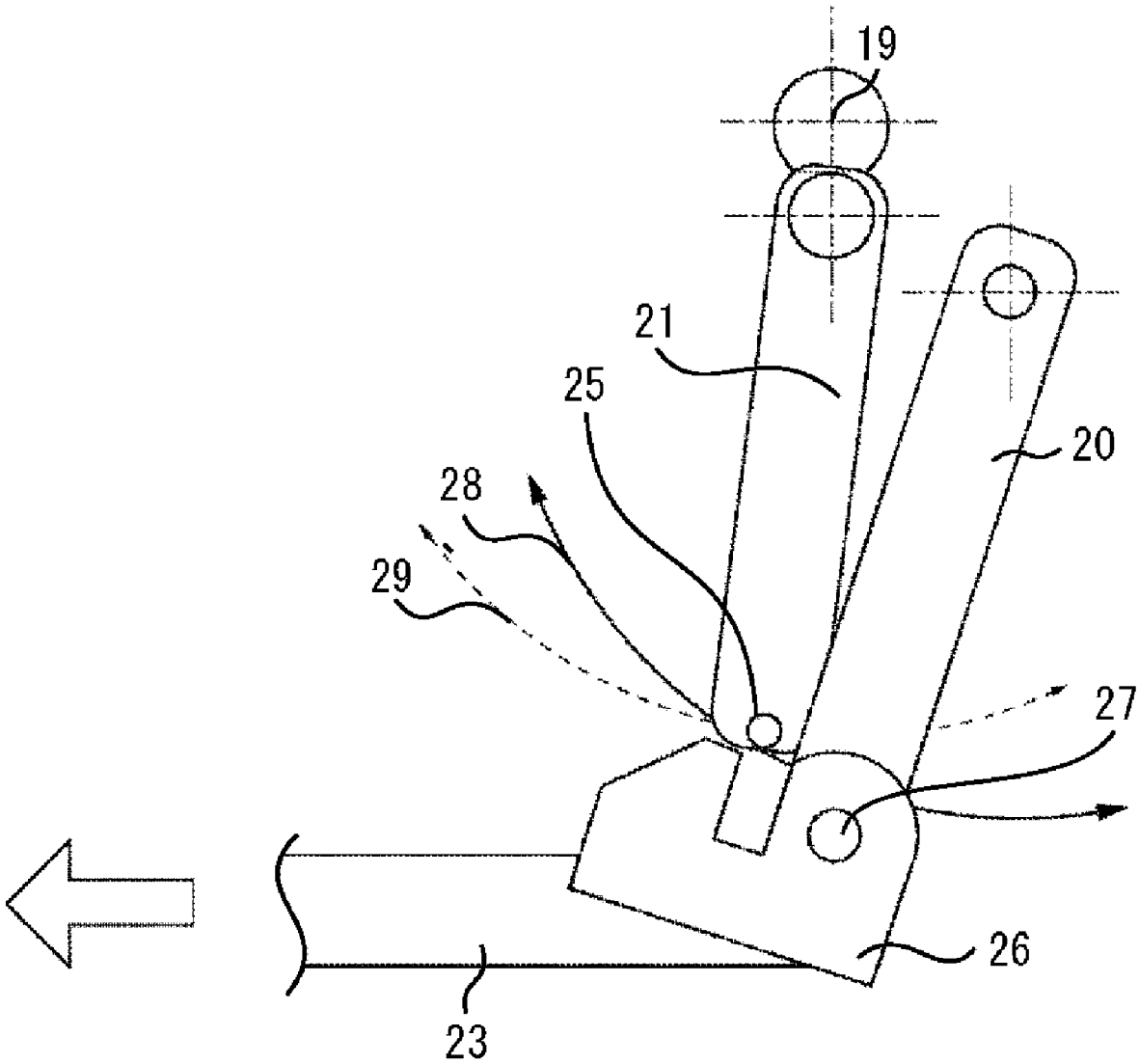
FIG. 7 is a diagram illustrating an operation of a release lever mechanism at the time of opening and closing a pinch roller.
Figure 8:
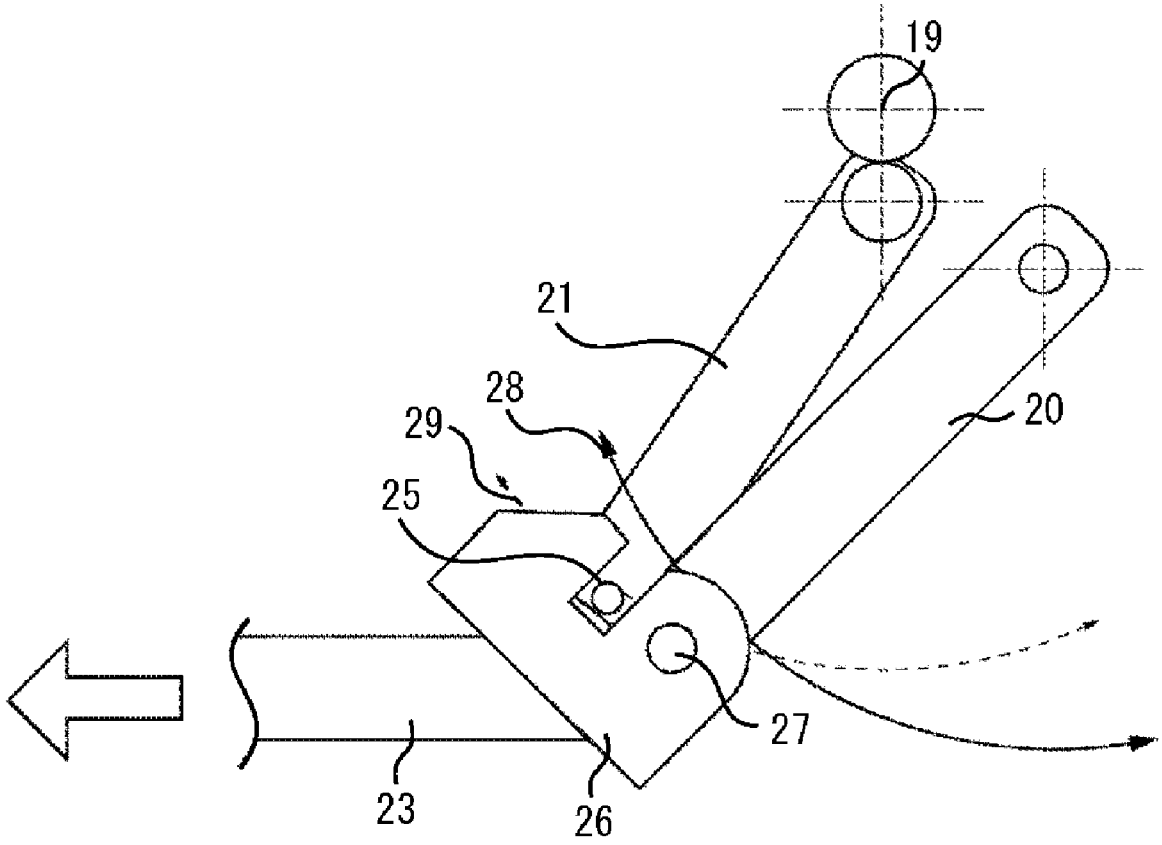
FIG. 8 is a diagram illustrating an operation of a release lever mechanism at the time of opening and closing a pinch roller.

Next, with reference to FIGS. 6 to 8, movement of the pinch roller 9 to the separated position (second position) is described when a user operates the release lever 22 in a case where the pinch roller 9 is in the urging position (the first position).

FIG. 6 illustrates a positional relation when the manual mechanism (the release lever 22 and the second rotation member 20) is in the default state. When a user pulls the release lever 22 in a direction of the arrow (leftward in the figure), the link plate 23 also moves to the left and the second rotation member 20 rotates as a locus 28 shows. The left side of the second rotation member 20 contacts the right side of the first rotation member 21 at this time and the first rotation member 21 is pushed by the second rotation member 20 to rotate similarly as the locus 29 shows in conjunction with the second rotation member 20.

In FIG. 7, the first rotation member 21 rotates clockwise together with the second rotation member 20, wherein locui of the engaging shaft 25 and the engaging portion 26 cross each other. The second rotation member 20 and the first rotation member 21 are interlocked with each other when the engaging shaft 25 enters into the nail-shaped part of the engaging portion 26. When the release lever 22 is further pulled in this state, the pinch roller 9 is completely separated from the conveyance roller (in the second position) and the device is released from the pinching state as illustrated in FIG. 8.

When the pinch roller 9 is manually returned from the second position to the first position, a user operates the release lever 22 in the reverse direction to return the link plate 23 to the pinching state as illustrated in FIG. 6. Since the engaging shaft 25 is engaged with the nail-shaped part of the engaging portion 26 in the state illustrated in FIG. 8, the first rotation member 21 also rotates counterclockwise together with the second rotation member 20. The pinch roller is moved in the engaging state until it comes into the position illustrated in FIG. 7 when the operation of the release lever 22 is continued. Thereafter, the second rotation member 20 is disengaged from the first rotation member 21, and the first member 21 is also returned to a default state as illustrated in FIG. 6 by a force of an elastic element that urges the arm 12.

Figure 9:
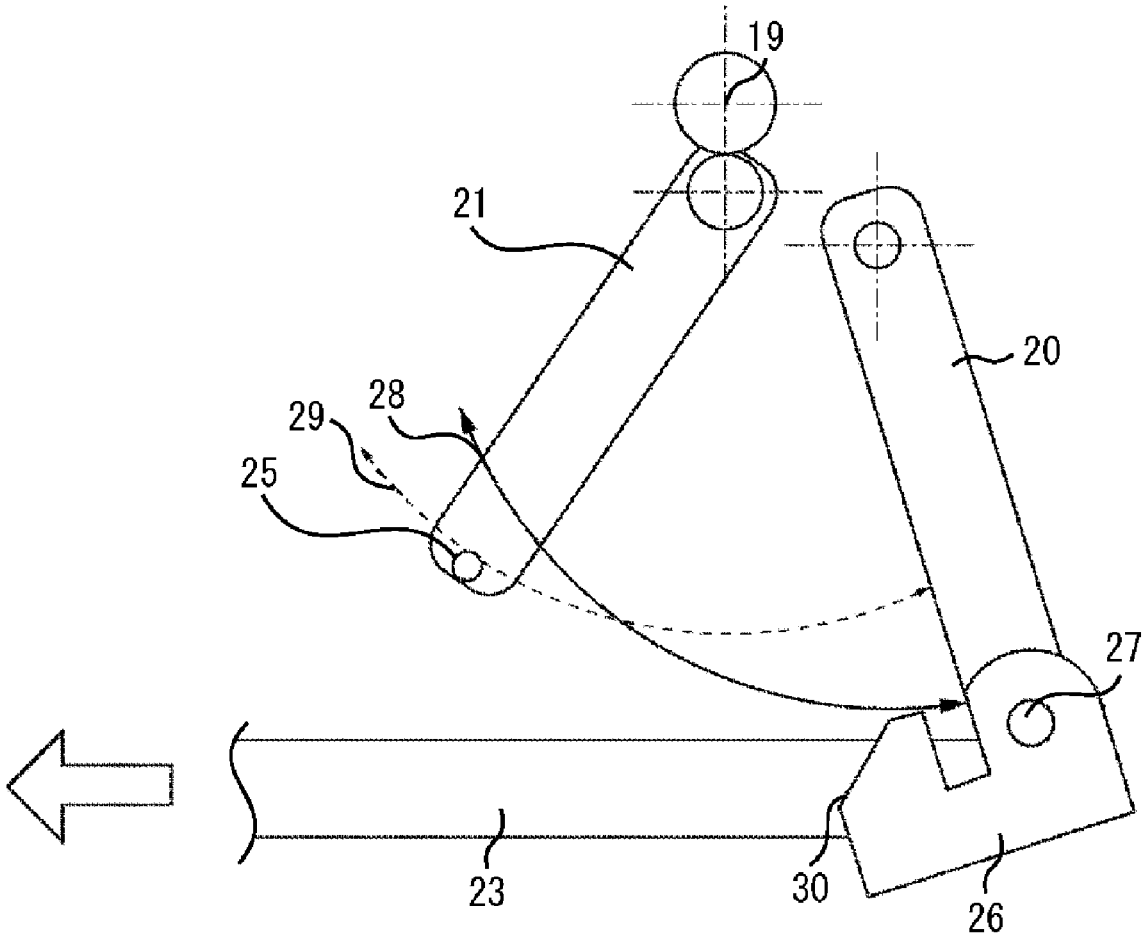
FIG. 9 is a diagram illustrating an operation of a release lever mechanism at the time of opening and closing a pinch roller.
Figure 10:
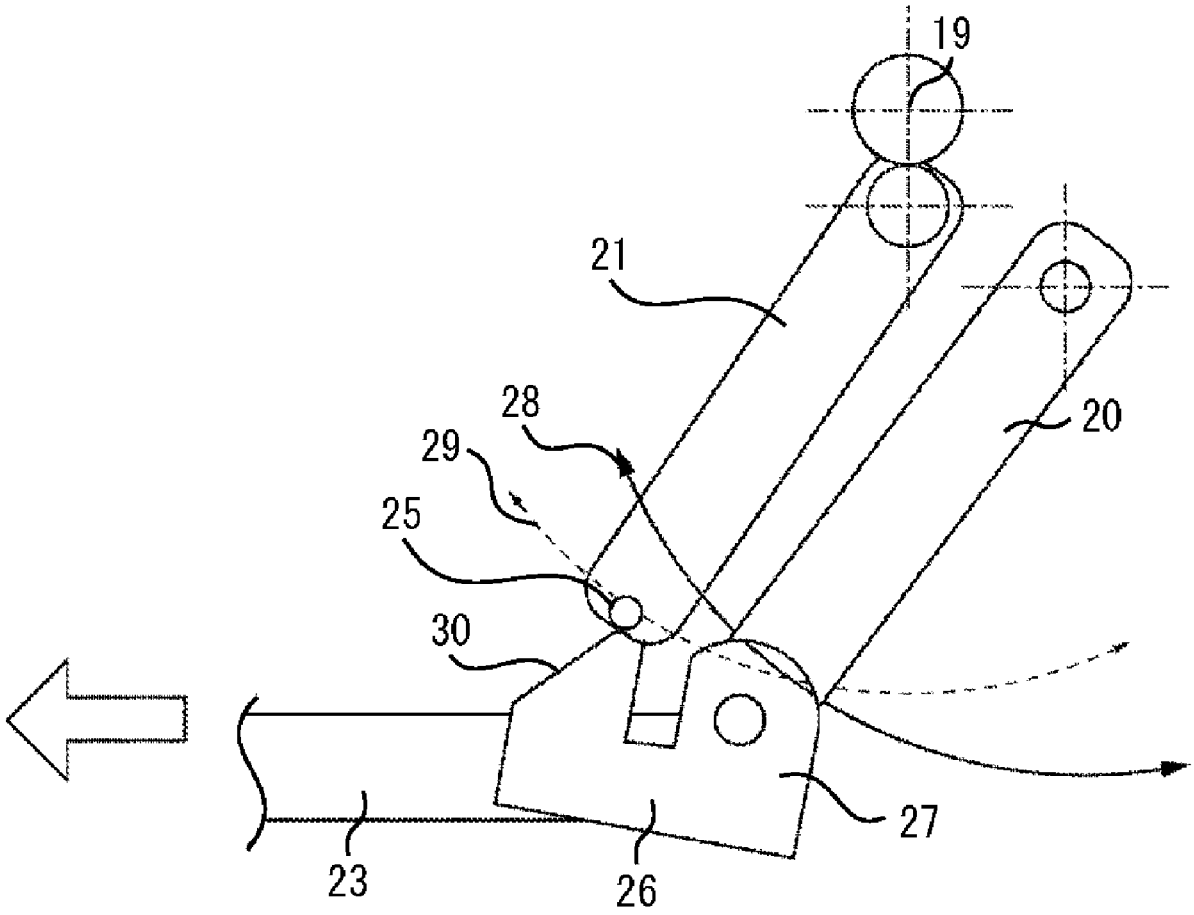
FIG. 10 is a diagram illustrating an operation of a release lever mechanism at the time of opening and closing a pinch roller.
Figure 11:
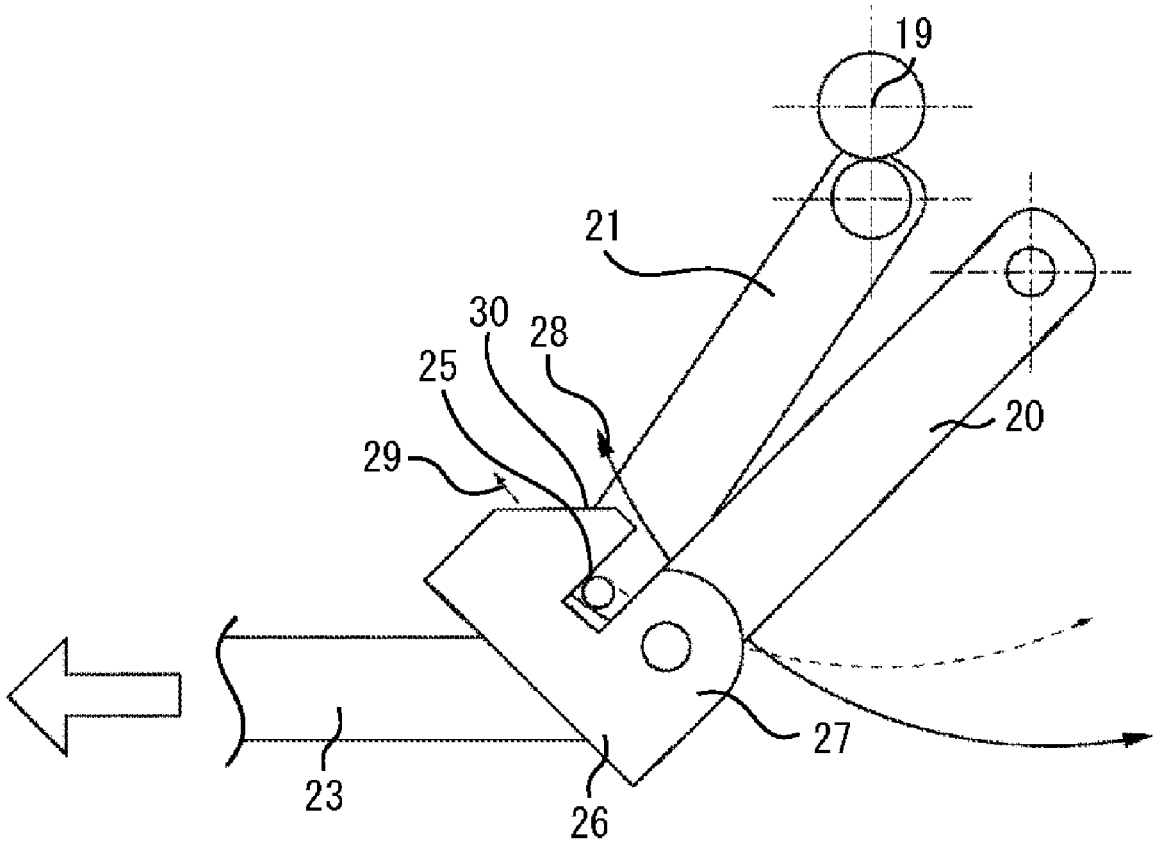
FIG. 11 is a diagram illustrating an operation of a release lever mechanism at the time of opening and closing a pinch roller.

Next, a recovery by a user's manual operation is described when the apparatus encounters an unexpected technical issue such as a power stoppage for some reason or a suspension of operation caused by system errors while using the printer with reference to FIGS. 9 to 11.

FIG. 9 illustrates a state where the system suspends its operation due to a technical issue when the driving mechanism has transferred the pinch roller 9 to the separated position (the second position). Only the first rotation member 21 stops at a position where it has swung to the left side in the figure. The manual mechanism (the second rotation member 20) is in a default state.

When the user pulls the release lever 22 to make a recovery, the second rotation member 20, pulled by the link plate 23, rotates to the left in the figure. When the engaging portion 26 comes to a position where the engaging portion 26 and the engaging shaft 25 contact each other, the engaging shaft 25 first contacts an abutting surface 30 of the engaging portion 26. If the rotation continues as is, the abutting surface 30 is pushed by the engaging shaft 25. Against the urging force of the elastic element such as a spring and rubber (not illustrated), the engaging portion 26 rotates counterclockwise around the rotation shaft 27 relative to the second rotation member 20 as illustrated by FIG. 10.

When the rotation is further continued as is, the engaging shaft 25 enters into the nail-shape part of the engaging portion 26, and concurrently under the force of the elastic element, the engaging portion 26 rotates clockwise relative to the second rotation member 20 to return to the start position as FIG. 11 illustrates. Thus, the first rotation member 21 and the second rotation member 20 are engaged and integrated with each other. By the integration, the manual force given by the release lever 22 of the manual mechanism can be transmitted to the roller opening and closing mechanism.

When the user pushes the release lever 22 in the right direction in the figure, the first rotation member 21 rotates in the right direction together with the second rotation member 20. Thus, even in a case where an apparatus does not work due to power failure or a system error, the pinch lever can be returned to the first position, which is a normal pinching position. Conversely, by the operation of the release lever 22, the position of the pinch roller 9 can be changed from the first position to the second position. Therefore, a state of the pinch roller 9 can be freely changed by user's will.

The above embodiment describes a return from a state where the system is suspended when the pinch roller 9 is at the position separated farthest from the conveyance roller. The first rotation member 21 is at the left most position in the figure. However, there is no telling at which timing a system suspension due to a technical issue occurs. In a case where the first rotation member 21 stops in the figure to the left side of a point where the rotation locus 28 of the engaging portion 26 and the rotation locus 29 of the engaging shaft 25 cross each other, manual return is executed according to the operation as described from FIGS. 9 to 11. When the first rotation member 21 stops in the figure at the right side of the crossing point, manual return is executed according to the operation as described from FIGS. 6 to 8.

Figure 12:
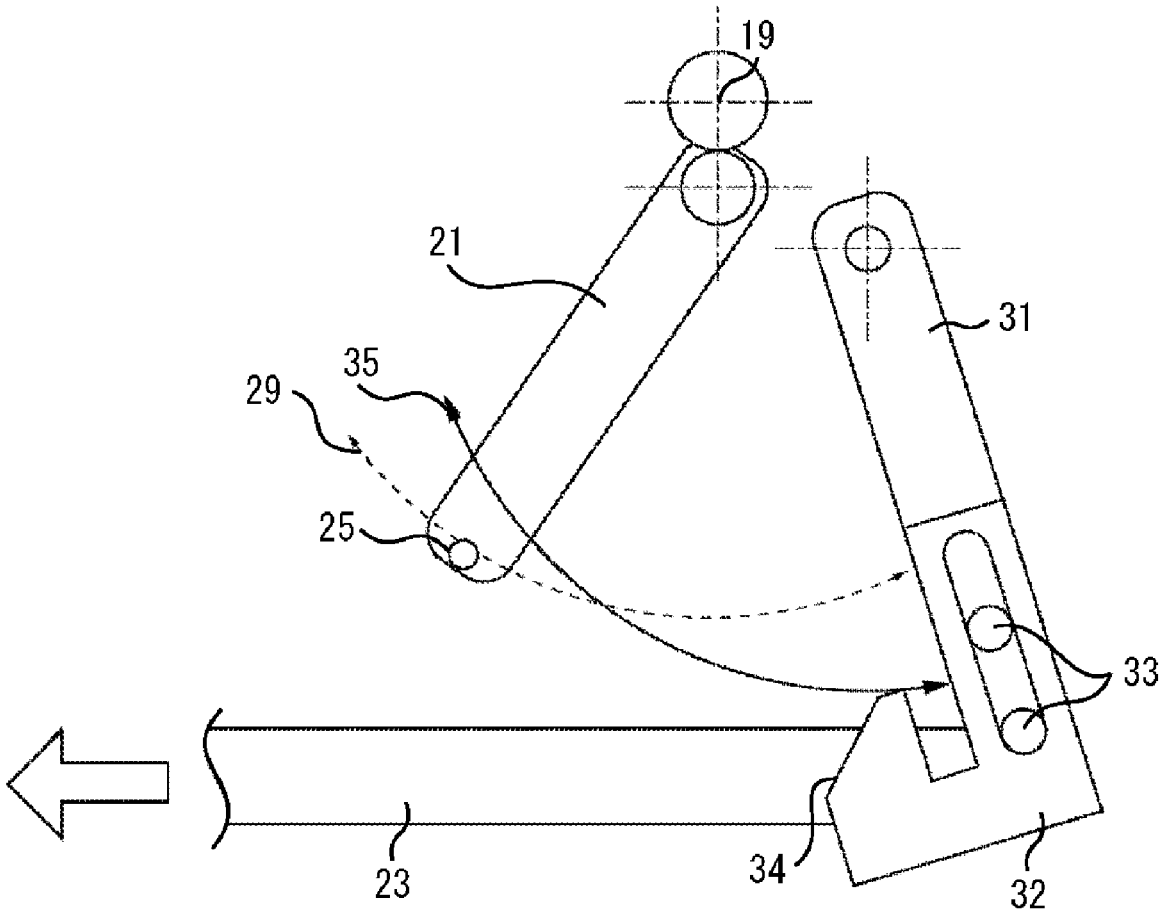
FIG. 12 is a diagram illustrating an operation of a release lever mechanism of a modified example according to the present exemplary embodiment.
Figure 13:
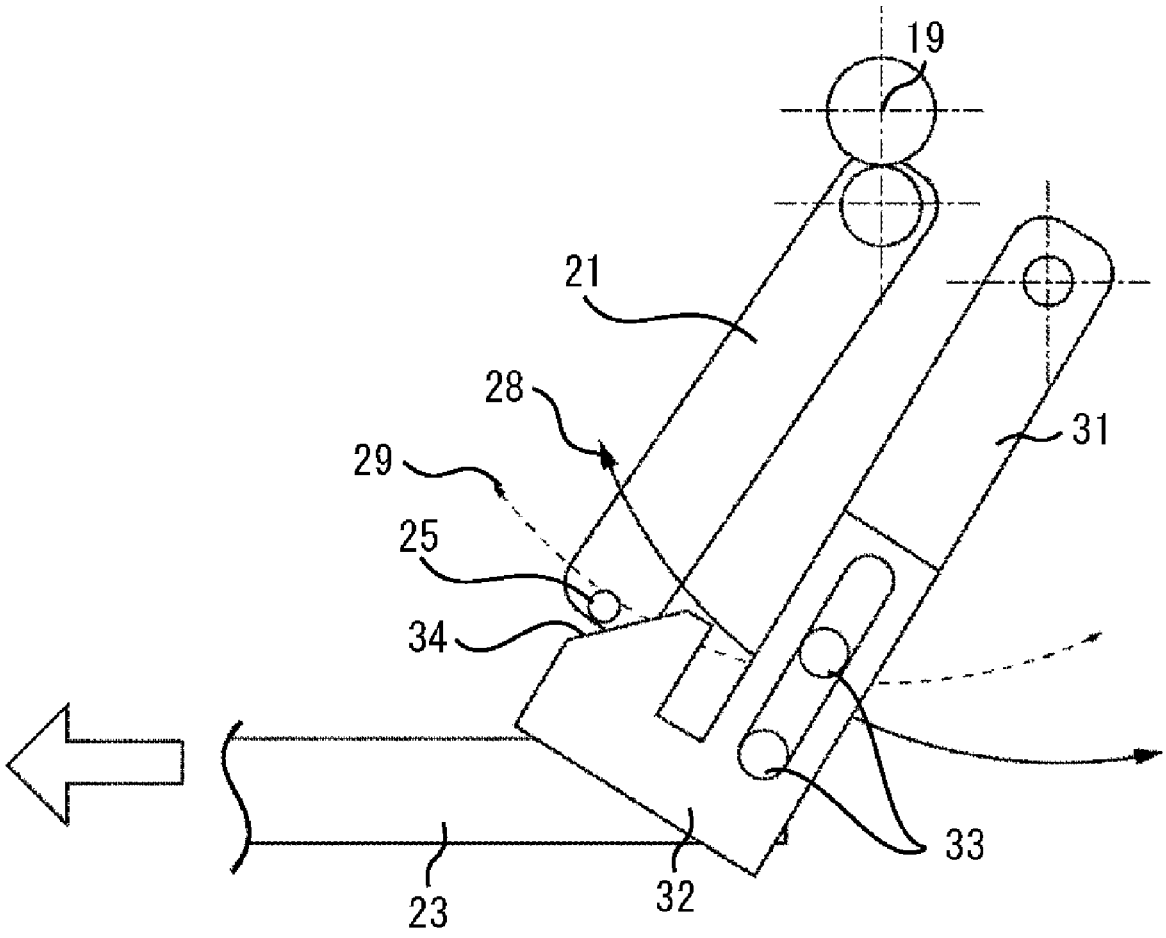
FIG. 13 is a diagram illustrating an operation of a release lever mechanism of a modified example according to the present exemplary embodiment.
Figure 14:
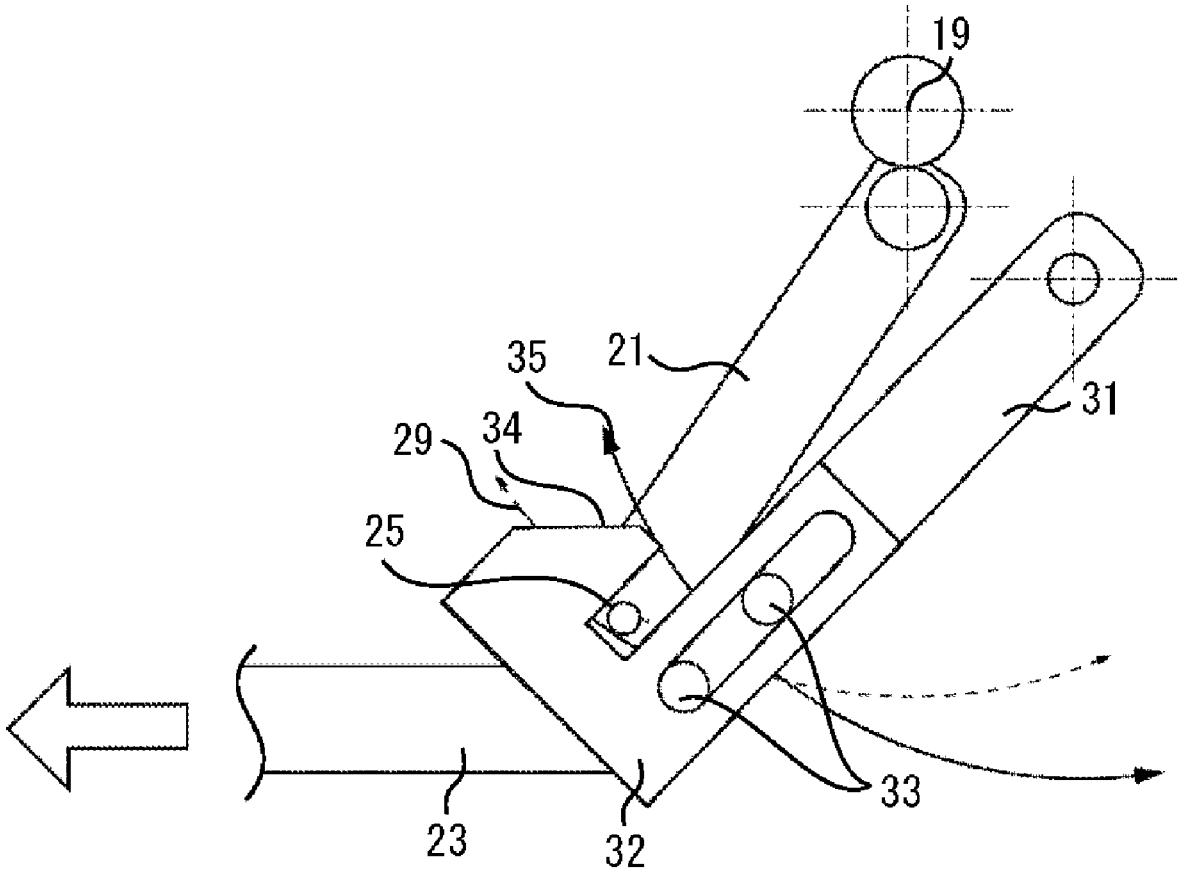
FIG. 14 is a diagram illustrating an operation of a release lever mechanism of a modified example according to the present exemplary embodiment.

Next, modification examples of the above exemplary embodiment are described using FIGS. 12 to 14. In comparison with the preceding examples, a structure and behavior of the engaging portion (the second engaging portion) provided in the second rotation member which engages with the engaging shaft 25 (the first engaging portion) provided in the first rotation member 21 are different. In the engaging portion 32 (the second engaging portion) held at a head of the second rotation member 31, a linear guiding hole is formed along the longitudinal direction of the second rotation member 31. On the second rotation member 31, two guide shafts 33 are fixed, to which the guiding holes of the engaging portion 32 are guided.

The engaging portion 32 is, thus, configured to straightly slide in the longitudinal direction (the rotational radius direction) of the second rotation member 31 instead of a rotational direction to be displaced. The elastic element such as a spring and rubber (not illustrated) is provided between the second rotation member 31 and the engaging portion 32, wherein the engaging portion 32 is urged to be normally in the position as illustrated in FIG. 12, so that the engaging portion 32 can move outside in the radius direction against the force of the elastic element.

FIG. 12 illustrates the pinch roller 9 in a state where the system has suspended due to technical issues when the pinch roller 9 is moved to the separated position (the second position) similar to the state illustrated in FIG. 9.

When the user pulls the release lever 22 to the left in the figure to make a recovery, the second rotation member 31, pulled by the link plate 23, rotates to the left in the figure. When the engaging portion 32 and the engaging shaft 25 come to a position where they contact each other, the engaging shaft 25 first contacts the abutment surface 34 of the engaging portion 26. The abutment surface 34 shows a slope surface inclining relative to the longitudinal direction of the second rotation member 32. If the rotation is continued as is, the abutment surface 34 is pushed by the engaging shaft 25 and the engaging portion 32 slides and moves outside in the radius direction relative to the second rotation member 31, under the force of the elastic element such as a spring and rubber (not illustrated), as illustrated in FIG. 13. Thus, the engaging portion is displaced.

When the rotation is further continued as is, the engaging shaft 25 enters into the nail-shaped part of the engaging portion 32, as FIG. 14 illustrates, and the force of the elastic element concurrently causes the engaging portion 32 to move in the opposite direction relative to the second rotation member 31, so that the engaging portion 32 returns to the start position. Thus, the first rotation member 21 and the second rotation member 31 are engaged and integrated with each other. Since the other operations are similar to what were previously described, the description is omitted.

In any of the exemplary embodiments as described above, a driving force of an electric system (motor driven mechanism) is configured to independently act on the rotation shaft (cam shaft) of the roller opening and closing mechanism that changes the clearance between a pair of rollers, without interfering with the manual system (release lever mechanism). In other words, transmission of the force generated at the driving source to the release lever is cut off when the manual mechanism is in a default state. Thus, the manual return to a normal state can be executed surely and immediately at the time of technical issues when an electric system is not operating due to power failure.

Since the clutch mechanism is provided in order to prevent transmission of the force from manual system to the electric system, a light operation is realized in a manual manipulation, which results in high practicality.

Since an inkjet printer using a roll sheet as described in the present exemplary embodiment continuously conveys a long sheet, maintenance operations are facilitated at the time of technical issues and the practicality is greatly increased.

According to the above described embodiments, the force of the manual mechanism acts from the second rotation member 20 on the first rotation member 21 and the rotation force of the first rotation member is transmitted to the cam shaft 15. Thus, the cam 16 is rotated and the pinch roller 9 is separated. As its modification example, the cam shaft and the cam can be eliminated, and the first rotation member and the arm can be directly linked at the time of manual operation. The modification example is described using FIGS. 15 and 16.

Figure 15:
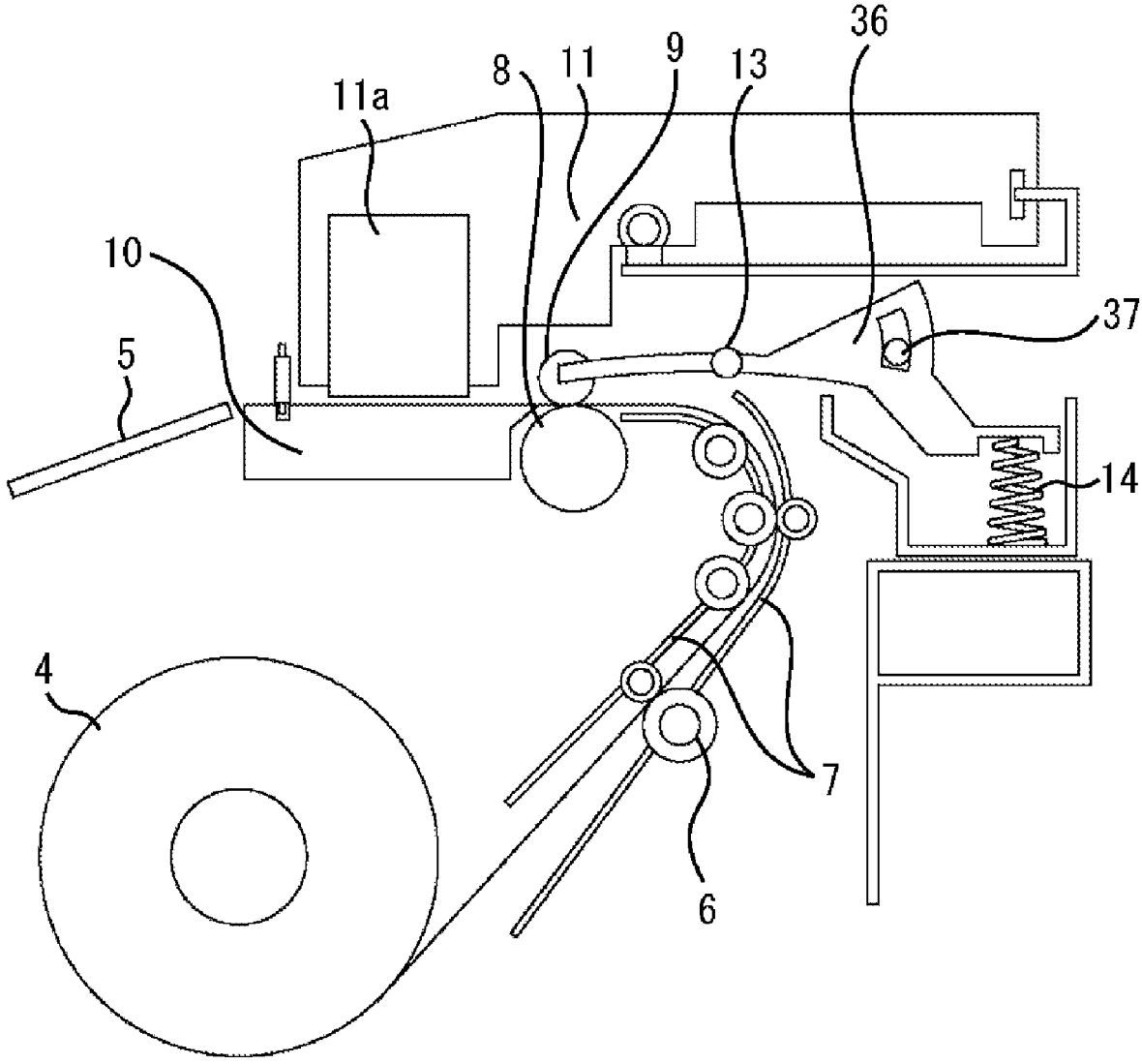
FIG. 15 is a diagram illustrating a structure of major sections of another modified example according to the present exemplary embodiment.

FIG. 15 is a diagram illustrating a structure of the main section. The pinch roller 9 is supported at one end of the arm 36 rotating around the supporting shaft 13. The other end of the arm 36 is urged upward by the spring 14. At a side opposite to the pinch roller 9 of the arm 36, a guide groove in an arc shape is formed coaxially with the supporting shaft 13. An engaging shaft 37 is inserted into the guide groove by an operation of the release lever 22. The engaging shaft 37 rotates coaxially with the supporting shaft 13 in the vertical direction in the figure.

Figure 16:
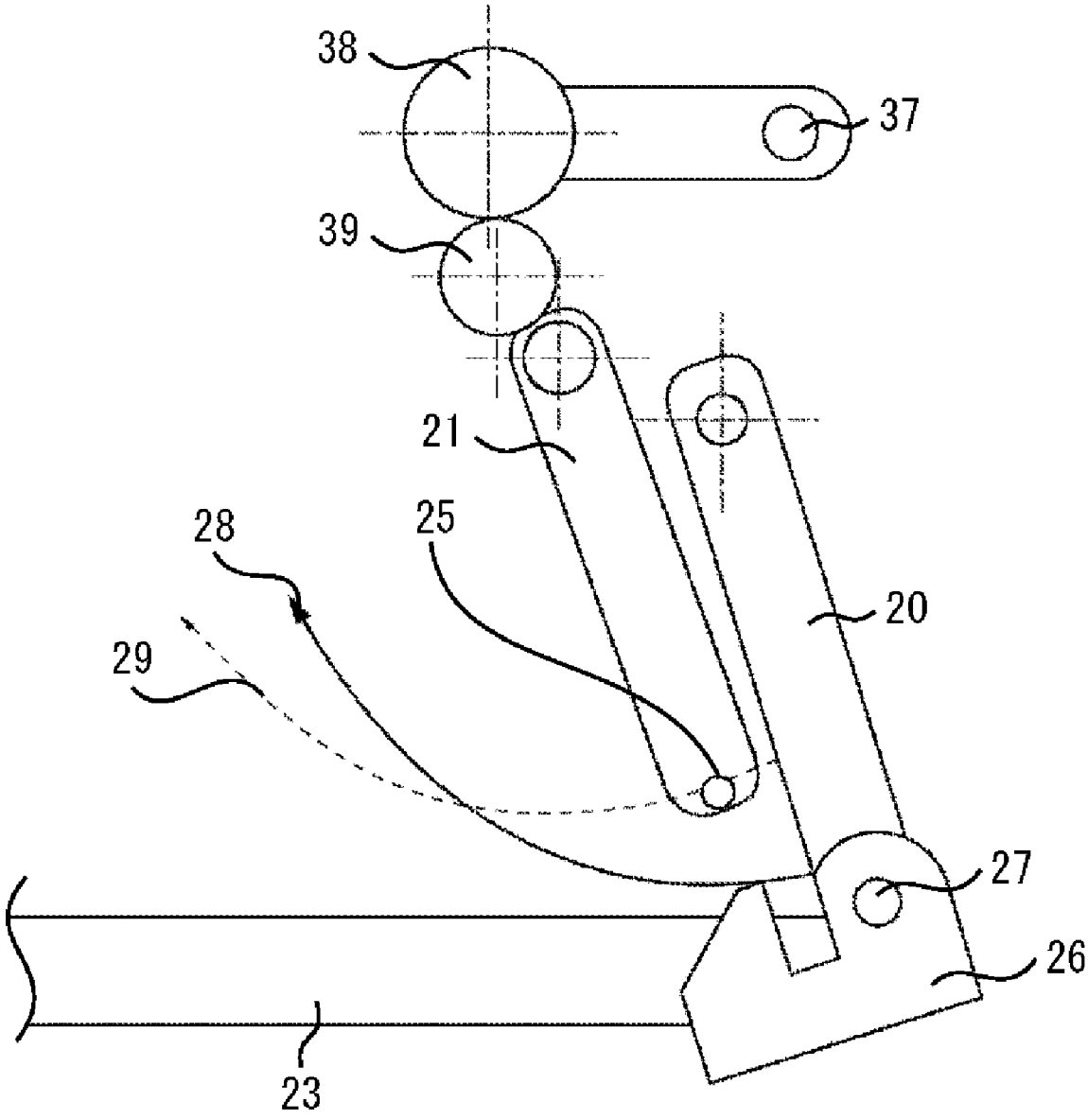
FIG. 16 is a diagram illustrating an operation of the release lever of another modified example according to the present exemplary embodiment.

FIG. 16 is a diagram illustrating a mechanism moving the engaging shaft 37 according to an operation of the release lever 22. The gear 38 is provided coaxially with the supporting shaft 13 of the arm 36. An arm-shaped member is attached to the gear 38, and the engaging shaft 37 is provided at its end. The gear 38 rotates in conjunction with the rotation of the first rotation member 21 via the gear 39. Further, the second rotation member 20 is provided relative to the first rotation member 21.

The engaging shaft 37 is in a normal state at a position which does not contact with a lower guide groove of the arm 36. The arm 36 is abutting on the conveyance roller 8 urged by a force of the spring 14. When the pinch roller 9 is to be separated, the engaging shaft 37 abuts on the lower guide groove of the arm 36 and rotates in the direction which pushes down the arm 36. The arm 36 is rotated in the clockwise direction in the figure against the force of the spring 14. Accordingly, the pinch roller 9 is lifted upward. Thus, a mechanism for opening and closing the roller is provided, which vertically moves the pinch roller 9 relative to the conveyance roller 8 and changes the clearance (distance) between both rollers.

When the user operates the release lever 22, the link plant 23 transmits its force, then the second rotation member 20 rotates, and the first rotation member 21 rotates in conjunction with it. This operation is similar to the exemplary embodiment as described above. The gear 39 and the gear 38 rotate in conjunction with this operation, so that the engaging shaft 37 vertically rotates. As a result, the pinch roller 9 supported by the arm 36 makes a movement.

Furthermore, the roller opening and closing mechanism is configured to work when the engaging shaft 37 rotates, not only by manual operation but also by the driving mechanism. This is realized by arranging the gear similar to the gear 38 coaxially with the gear 38 and connecting the gear to the driving mechanism having a driving source such as an electric motor. Similar to the exemplary embodiment as described before, the clutch mechanism is provided in the driving mechanism and the clutch is turned off except when the motor drives the mechanism in order to cut off transmission of the rotation caused by manual operation to the driving source. In other words, driving forces for the electric system and manual system do not interfere with each other. The user can therefore operate the release lever 22 with a small force to open and close the pinch roller 9.

In the above descriptions, the present invention is applied, as an example, to a conveyance roller to which the rotational driving force for conveying a sheet is given, and to a pair of pinch rollers that are driven by the conveyance roller. However, the present invention is not limited to these embodiments but the following exemplary embodiments are also available.

For example, both roller pairs which pinch the sheet can be follower rollers, or both of them can be rollers having a driving force. A number of the roller pairs that pinch a sheet is not limited to two (i.e., one at both sides respectively). At least, roller pairs on one side which pinch a sheet from its front and back can be two or more roller pairs. In other words, single to plural roller pairs, or plural to plural roller pairs are available.

Furthermore, exemplary embodiments of the present invention are not limited to rollers directly contacting each other at the time of the sandwiching operation. The present invention can also be applied to rollers indirectly contacting each other. For example, at least on one side, a belt may be entrained over a plurality of rollers as a unit, wherein the unit moves to rollers on the other side to make contact across the belt. The present invention refers to either of the configurations as a pair of rollers.

While the present invention has been described with reference to exemplary embodiments, it is to be understood that the invention is not limited to the disclosed exemplary embodiments. The scope of the driving claims is to be accorded the broadest interpretation so as to encompass all modifications, equivalent structures, and functions.

This application claims priority from Japanese Patent Application Nos. 2008-194801 filed Jul. 29, 2008, and 2009-135314 filed Jun. 4, 2009 which are hereby incorporated by reference herein in their entirety.

What is claimed is:

1. A sheet conveying apparatus comprising:

a pair of rollers configured to pinch a sheet to be conveyed;

a driving source;

a roller mechanism configured to change a clearance between the pair of rollers with a force generated by the driving source; and a manual mechanism including an operation member which a user manually moves and a transmission mechanism configured to transmit a manual force from the operation member to the roller mechanism to change the clearance between the pair of rollers, wherein the transmission mechanism is configured to cut off transmission of the force generated by the driving source to the operation member when the operation member is not operated by the user; and a clutch mechanism provided in a transmission path between the driving source and the roller mechanism, wherein the clutch mechanism transmits the force generated by the driving source to the roller mechanism, and cuts off transmission of the manual force from the operation member to the driving source.

2. The sheet conveying apparatus according to claim 1, wherein one roller of the pair of rollers is a conveyance roller configured to generate a rotational driving force for conveying a sheet, a second roller is a pinch roller driven by the sheet or the conveyance roller, which moves to apply a force to the conveyance roller, or to separate from the conveyance roller.

3. The sheet conveying apparatus according to claim 2, wherein:

the roller mechanism includes an arm turnably holding the pinch roller driven by the sheet or the conveyance roller, the arm can move to apply the force to or separate from the conveyance roller, and the transmission mechanism includes a first rotation member rotating in conjunction with movement of the arm, and a second rotation member rotating in conjunction with the operation of the operation member, wherein the first rotation member does not act on the second rotation member, and the second rotation member does not rotate even when the first rotation member rotates in a case where the driving mechanism moves the pinch roller, and wherein the second rotation member acts on the first rotation member to rotate the first rotation member together with the second rotation member in a case where the pinch roller is moved by the operation member of the manual mechanism.

4. The sheet conveying apparatus according to claim 3, wherein the transmission mechanism further comprising:

a cam configured to apply a force to the arm to move the arm;

a cam shaft rotating the cam; and a gear configured to interlock the rotation of the cam shaft with the rotation of the first rotation member;

wherein the rotational driving force is given to the cam shaft from the driving source.

5. The sheet conveying apparatus according to claim 3, wherein the first rotation member and the second rotation member are capable of engaging each other with an engaging mechanism, wherein the engaging mechanism is engaged to interlock the first rotation member with the second rotation member in a case where the second rotation member acts on the first rotation member and moves the pinch roller to separate from the conveyance roller, and wherein the engagement of the engaging mechanism is released and the first rotation member and the second rotation member are not interlocked in a case where the pinch roller is moved to a position where the pinch roller contacts the conveyance roller.

6. The sheet conveying apparatus according to claim 5, wherein the engaging mechanism includes a first engaging portion provided on the first rotation member, and further a second engaging portion provided on the second rotation member to which a force is applied by an elastic element to be at a default position, and which can be displaced relative to the second rotation member against the applied force and has a shape that engages with the first engaging portion, and wherein, in case of the engagement, by the contact of the first engaging portion and the second engaging portion, the second engaging portion is displaced relative to the second rotation member against the applied force, and then the second engaging portion returns to the default position under the applied force.

7. The sheet conveying apparatus according to claim 6, wherein the second engaging portion is supported by a shaft provided on the second rotation member, wherein the second engaging portion rotates around the shaft and is displaced relative to the second rotation member.

8. The sheet conveying apparatus according to claim 6, wherein the second engaging portion is displaced straightly along its longitudinal direction relative to the second rotation member.

9. An image forming apparatus comprising:

a sheet conveying apparatus according to claim 1; and an image forming unit configured to form an image on the sheet.

10. The image forming apparatus according to claim 9, wherein the image forming unit further comprises an inkjet recording head, and the sheet is a roll sheet.

* * * * *